US006592334B1

(12) United States Patent
Butler

(10) Patent No.: US 6,592,334 B1
(45) Date of Patent: Jul. 15, 2003

(54) HYDRAULIC MULTIPHASE PUMP

(75) Inventor: Bryan Virge Butler, Garrison, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/036,737

(22) Filed: Dec. 21, 2001

(51) Int. Cl.[7] ..... F04B 49/00

(52) U.S. Cl. ..... 417/46; 417/53; 417/344; 417/346

(58) Field of Search ..... 417/53, 46, 339, 417/344, 346, 399, 402; 60/476, 464, 546; 91/171, 515

(56) References Cited

U.S. PATENT DOCUMENTS 3,583,282 A * 6/1971 Cope ..... 91/25
5,344,290 A * 9/1994 Benckert ..... 417/342
5,622,478 A * 4/1997 Elliott et al. ..... 417/53
5,634,773 A * 6/1997 Tanino et al. ..... 417/46
6,171,075 B1 * 1/2001 Munzenmaier et al. ..... 417/342

* cited by examiner

*Primary Examiner*—Charles G. Freay
*Assistant Examiner*—William H. Rodriguez
(74) *Attorney, Agent, or Firm*—Moser, Patterson & Sheridan, L.L.P.

(57) ABSTRACT

The present invention provides a hydraulically driven multiphase pump system and methods for pumping a fluidstream from the surface of a well. The hydraulically driven multiphase pump system consists of two vertically disposed plungers. The plungers are hydraulically controlled and actuated to work in alternate directions during a cycle using a closed loop hydraulic system. Each cycle is automatically re-indexed to assure volumetric balance in the circuits. An indexing circuit ensures that each plunger reaches its full extended position prior to the other plunger reaching its preset retracted position. A bias member and an acceleration valve are used to prime the indexing circuit for use in low or variable inlet pressure situations. A power saving circuit is used to transfer energy from the extending plunger to the retracting plunger.

36 Claims, 5 Drawing Sheets

HYDRAULIC MULTIPHASE PUMP

BACKGROUND OF THE INVENTION

1. Field of the Invention

The present invention generally relates to an apparatus and method used to transport hydrocarbons from a wellbore to another location. More particularly, the invention relates to a multiphase pump for transporting hydrocarbons from the surface of a producing well. More particularly still, the invention relates to a pump having two vertically disposed plungers and circuitry providing more efficient operation of the pump.

2. Description of the Related Art

Oil and gas wells include a wellbore formed in the earth to access hydrocarbon bearing formations. Typically, a borehole is initially formed and thereafter the borehole is lined with steel pipe, or casing in order to prevent cave in and facilitate the isolation of portions of the wellbore. To complete the well, at least one area of the wellbore casing is perforated to form a fluid path for the hydrocarbons that either flow upwards to the surface of the well due to naturally occurring formation pressure or are urged upwards with some form of artificial lift. Regardless of the manner in which the hydrocarbons reach the surface of the well, this flow will arrive as a mixture of oil, gas, dirt and sand which is referred to as a "wellstream" or "fluidstream". The fluidstream is then transported by a flowline to a predetermined location, such as a separator where it may be separated into gas, liquids, and solids. If the fluidstream cannot flow to the separator, it may be pumped by a multiphase pump. These pumps must be capable of moving volumes of the oil, gas, water or other substances making up the fluidstream. The pumps can be located offshore or onshore and can be connected to a single or multiple wellheads through the use of a manifold.

Over the past 20 years, two principle types of rotary pumps have been used as multiphase pumps: the twin screw pump and the helico-axial pump. The twin screw pump is a positive displacement pump constructed basically of two intermeshing screws. The fluidstream enters the pump from the wellhead and is trapped between the screws of the pump. The rotation of two screws forces the fluidstream into the downstream flowline. The helico-axial style pump combines positive displacement with dynamic compression and is basically constructed of turbine blades in combination with a screw drive. This combination imparts energy from turbine blades and the screw drive into the discharged fluids.

The rotary style multiphase pumps have been popular due to their long market exposure but have demonstrated deficiencies. Maintenance problems that usually require more than 24 hours to resolve is one deficiency that affects both the twin screw pump and the helico-axial pump. Many of these problems are associated with erosion or heat that damage the mechanical seals. Sand can also erode the screws and liners of the pumps. Excessive amounts of gas can cause a reduction in the dynamic performance occur in the helico-axial pumps and can lead to build up and gas locking in the twin screw pumps. Conversely, excessively long liquid slugs can affect the efficiency of the helico-axial pumps.

A horizontal, reciprocating pump has been successfully deployed for low to medium gas volume fraction applications. This pump contains horizontal rams that are moved in and out by a rotating crankshaft. The pump has reasonable tolerance for sand in the well stream. It uses replaceable liners to cover and protect the compression cylinders which can be changed in the field. Even though the horizontal reciprocating pump overcomes some of the deficiencies of a rotary style multiphase pump it may experience dynamic problems if the flow is mainly gas.

More recently, a vertical reciprocating pump (the RamPump™) has been used to transport well stream. This pump was introduced to overcome deficiencies of rotary pumps. It operates at a slower pace than the rotary pumps, using larger volume chambers and long strokes to attain the flow rates desired. Due to the slow fluid velocities and vertical plunger design, sand and other impurities from a wellbore have little adverse effect on its moving parts. Because it has no rotating mechanical seals; it can handle a full range of fluid mixtures without requiring liquid trapping or re-circulation to insure seal survival. Preferably driving cylinders are placed in line with their respective plungers. Power fluid supplied from a pressure compensated pump is used to drive one plunger fully down, triggering a sudden pressure increase at the end of the stroke. This pressure spike is used to shift a shuttle valve, causing the swash plate of the compensated pump to reverse angle and to redirect the power fluid to the opposite cylinder. Each power circuit is connected to the piston end of one cylinder and also to the rod end of the other cylinder, thus assuring that the opposite plunger will be driven upward when the first plunger is moving downward.

Even though the vertical RamPumps™ overcomes many of the deficiencies in the prior pumps, problems still exist with the use of vertical plungers in a hydraulically driven multiphase pump. For example, if a deficit of hydraulic fluid occurs, the pump will pause, and go to neutral, and may need intervention to restart. In another example, pressure spikes created during the operation of the hydraulically driven pump can cause premature failures in relief valves and hoses at the end fittings. These pressure spikes occur when one of the plungers reaches its preset retracted position and thereby causing the fluid to be further compressed in the hose without any way of escape. This increase pressure is utilized in the system to cause the swash plate in the pressure compensated pump to reverse angle thereby redirecting the flow of hydraulic fluid to the opposite cylinder. Since the swash plate does not change direction instantaneously, the pressure continues to increase in the hoses thereby causing a very high pressure spike resulting in failure of hydraulic components. In yet another example, when an inlet pressure is insufficient to raise the ascending plunger ahead of the descending plunger the pump begins to short stroke on subsequent cycles and ultimately stop pumping. The combination of these problems greatly reduced the functionality of hydraulically driven multiphase pump.

In view of the deficiencies of currently available hydraulically driven multiphase pump a need exists for a hydraulically driven pump that operates effectively and efficiently in pumping multiphase liquids and does not systematically pause during a pumping cycle. There is a further need for a hydraulically driven multiphase pump that is not subject to premature failure of hydraulic components and hoses. There is yet a further need for a hydraulically driven multiphase pump that does not short stroke while operating in various pressure conditions.

SUMMARY OF THE INVENTION

The present invention provides a hydraulically driven multiphase pump system with improved efficiency due to elimination of pressure spikes and priming problems of the plunger moving toward the extended position. The hydraulically driven multiphase pump system consists of two vertical disposed plungers. The plungers are hydraulically controlled and actuated to work in alternate directions during a stroking cycle using a closed loop hydraulic system. Each cycle is automatically re-indexed to assure volumetric balance in the circuits. An indexing circuit ensures that each plunger reaches its full extended position prior to the other plunger reaching its preset retracted position. The multiphase pump system is capable of operating in 100% gas and 100% liquids without requiring auxiliary liquid circuits.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
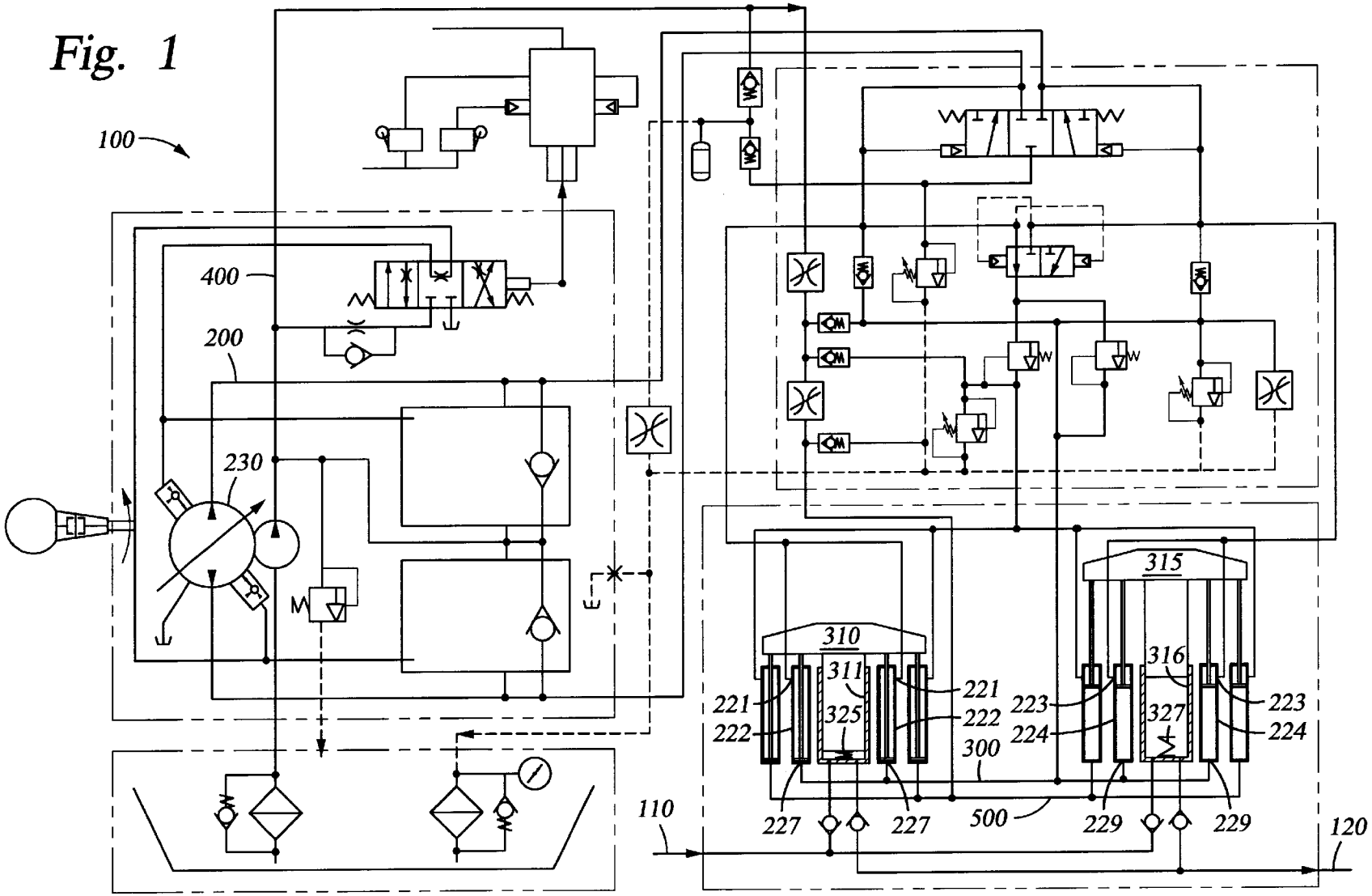
FIG. 1 is a schematic view of a complete hydraulically driven multiphase pump system.

FIG. 1 is a schematic view of a complete hydraulically driven multiphase pump system 100. For ease of explanation the invention will be first be described generally with respect to FIG. 1, thereafter more specifically with FIGS. 2–5. The system 100 contains a first 310 and second 315 plunger, each movable between an extended position and a retracted position. The first plunger 310 is moveable by a first and a second hydraulic cylinders 222. The second plunger 315 is movable by a first and a second hydraulic cylinders 224. When the first plunger 310 is moving toward the extended position, a suction is created by the plunger 310, urging the fluidstream from the wellbore to enter the system 100 through an inlet 110 and fill a first plunger cavity 311. Simultaneously, the second plunger 315 is moving in an opposite direction toward a preset retracted position, thereby expelling the fluidstream in a second plunger cavity 316 to a discharge 120. As the first plunger 310 reaches its full extended position, the second plunger 315 then reaches its preset retracted position, thereby completing a cycle. The first plunger 310 then moves toward the preset retracted position expelling the fluidstream into the discharge 120, as the second plunger 315 moves toward the extended position creating a suction and urging the fluidstream to enter the inlet 110. In this manner, the plungers operate as a pair of substantially counter synchronous fluid pumps. While the described embodiment includes plungers acting in a counter-synchronous manner, it will be understood that so long as they move in a predetermined way relative to one another, a predetermined phase relationship, the plungers can assume any position as they operate.

The plungers 310, 315 move in the opposite directions causing continuous flow of fluid from the inlet 110 to the discharge 120. A first biasing member 325 is disposed at the lower end of the first plunger 310, to facilitate the movement of the first plunger 310 toward the extended position. A second biasing member 327 is disposed at the lower end of the second plunger 315 to facilitate the movement of the second plunger 315 toward the extended position. The hydraulic cylinders 222, 224 are shown on the side of the plungers 310, 315, which is a preferred embodiment. However, this invention is not limited to orientation of the hydraulic cylinders 222, 224 as shown on FIG. 1. For instance, depending on space requirement the plungers can be disposed in any orientation that is necessary and effective.

The system 100 includes a closed loop circuit 200 for supply of hydraulic fluid from a pressure compensated pump 230 to a rod end 221 of the first and the second hydraulic cylinders 222 of the first plunger 310 and to a rod end 223 of the first and the second hydraulic cylinders 224 of the second plunger 315. The system 100 also includes an indexing circuit 300 providing hydraulic fluid to and from a blind end 227 of the first and the second hydraulic cylinders 222 of the first plunger 310 and to a blind end 229 of the first and the second hydraulic cylinders 224 of the second plunger 315. The indexing circuit 300 ensures that one plunger reaches its full extended position prior to the other plunger reaching its preset retracted position. Additionally, the system 100 further includes a power saving circuit 500 to transfer energy between the first 310 and the second 315 plunger. The system 100 further includes a charge circuit 400 for providing hydraulic fluid to the closed loop circuit 200, the indexing circuit 300 and the power saving circuit 500.

Figure 2:
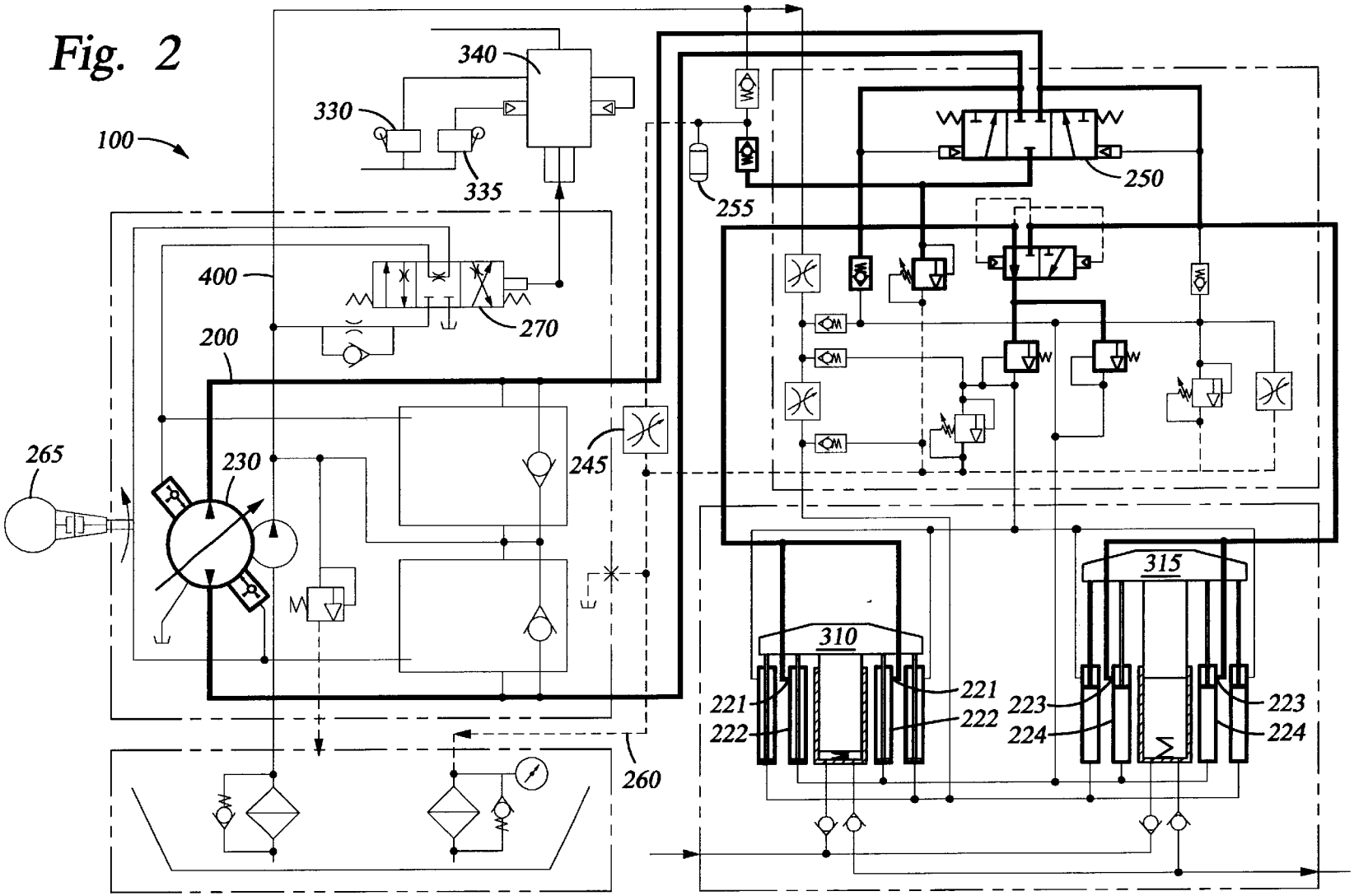
FIG. 2 is a schematic view showing a closed loop circuit in the hydraulically driven multiphase pump system.

FIG. 2 is a schematic view showing the closed loop circuit 200 in the hydraulically driven multiphase pump system 100. In the circuit 200, the rod end 221 of the first and the second hydraulic cylinders 222 of the first plunger 310 and to the rod end 223 of the first and the second hydraulic cylinders 224 of the second plunger 315 is connected to the pressure compensated hydraulic pump 230. The pump 230 is energized by an external power source 265 such as an electric motor or an engine. The circuit 200 further includes a first 330 and a second 335 limit switch to commence the reversal of fluid flow by the pressure compensated hydraulic pump 230. During a cycle, the pump 230 directs hydraulic fluid towards the first and the second hydraulic cylinders 222 of the first plunger 310 thereby causing the plunger 310 to move towards the retracted position. Once the plunger 310 reaches the preset retracted position, the limit switch 330 is triggered. The first 330 and the second 335 limit switches are arranged and constructed to trigger a signal to box 340. The box 340 is connected to a control valve 270 which causes the pressure compensated pump 230 to redirect the flow of fluid in the closed loop circuit 200. When redirected, the pump 230 draws the fluid from the rod end 221 the first and the second hydraulic cylinders 222 of the first plunger 310 in the retracted position and sends the fluid to the rod end 223 of the first and the second hydraulic cylinders 224 of the second plunger 315 in the extended position, thereby completing a cycle. The first 330 and the second 335 limit switches are movable to adjust the first 310 and the second 315 plunger preset retracted positions in order to optimize the pump cycle. The pump system is optimized when the volume of well stream pumped over time is increased.

In the event the circuit 200 experiences leakage through a loop flushing valve 245 or through normal leakage from the compensated pump 230 to a drain 260, a replenishment flow of fluid can be introduced into the closed loop circuit 200 by means of the charge circuit 400. The charge circuit 400 includes an accumulator 255 that stores fluid under pressure. A valve 250 between the accumulator 255 and the closed loop circuit 200 permits fluid introduction to the closed loop circuit 200 in the event that fluid pressure in the circuit 200 falls below a preset valve.

Figure 3:
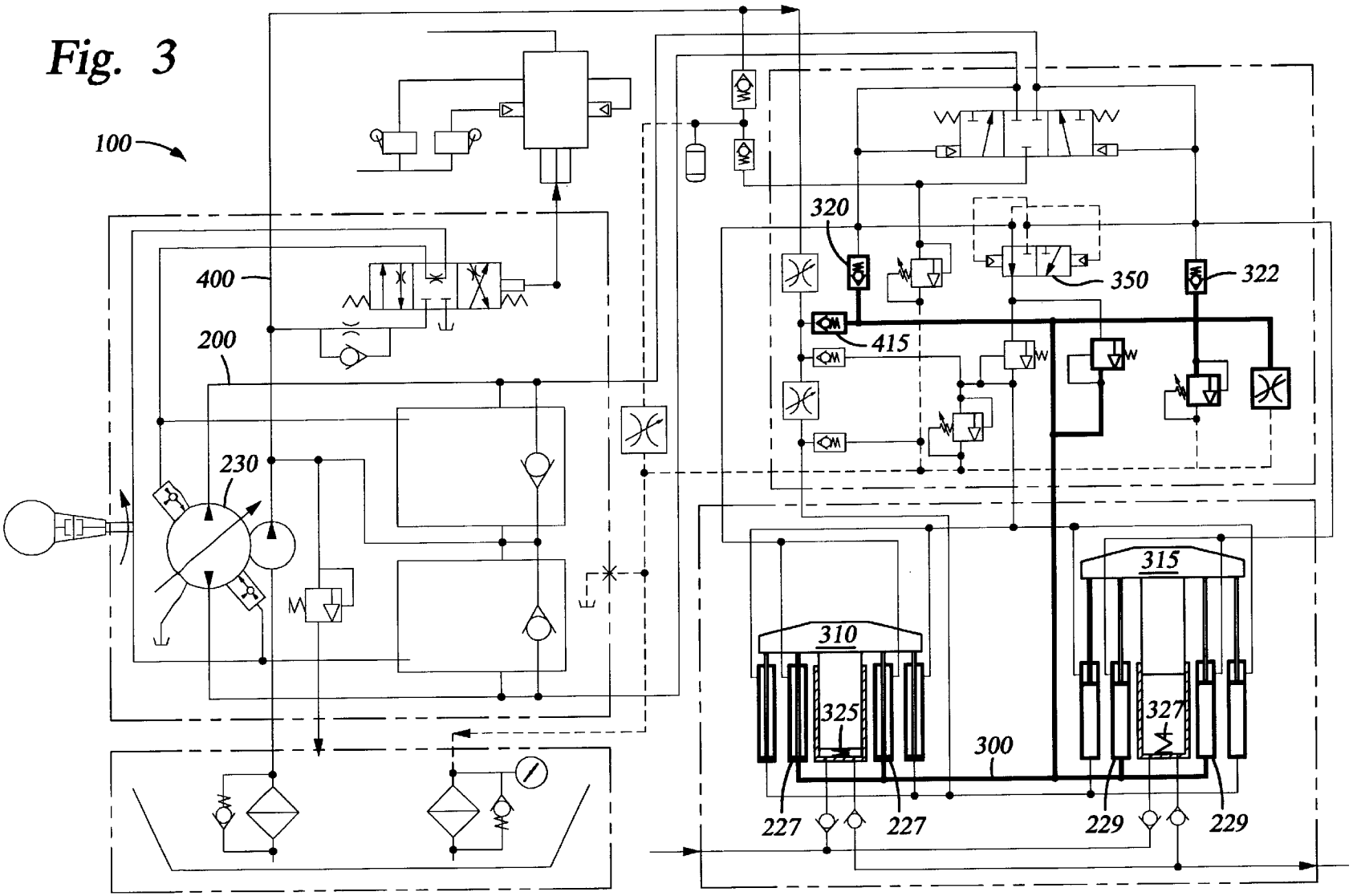
FIG. 3 is a schematic view showing a indexing circuit in the hydraulically driven multiphase pump system.

FIG. 3 is a schematic view showing the indexing circuit 300 in the hydraulically driven multiphase pump system 100. The indexing circuit 300 ensures that each plunger reaches its full extended position prior to the other plunger reaching its preset retracted position. Circuit 300 connects the blind end 227 of the first and the second hydraulic cylinders 222 of the first plunger 310 to the blind end 229 of the first and the second hydraulic cylinders 224 of the second plunger 315. In a low inlet pressure scenario, the extending plunger has less external force urging it toward the extended position. To compensate, the pressure increases in the indexing circuit 300 thereby preventing fluid introduction by the charge circuit 400. One feature to address this problem is the use of an acceleration valve 350 for selective communication with the closed loop circuit 200 and the indexing circuit 300. As the pump system 100 completes a cycle and one of the plungers moves from the extended position to the retracted position, the acceleration valve 350 briefly provides a small volume of fluid from the closed loop circuit 200 to the indexing circuit 300. This fluid entering the indexing circuit 300 accelerates the movement of the plunger towards its extended position, thereby assuring that the plunger will reach its full extended position prior to the time the other plunger reaches its preset retracted position. A second feature in the preferred embodiment for low inlet pressures is the use of the first 325 and the second 327 biasing member for biasing at least one of the plungers as the plunger moves from the retracted position. The first biasing member 325 propels the first plunger 310 towards the extended position, thereby temporarily lowering pressure in the indexing circuit 300 below the pressure in the charge circuit 400. A first pressure sensing member 415 in the charge circuit 400 opens and introduces fluid to the indexing circuit 300. This fluid further ensures that the plunger moving toward the extended position will arrive prior to the time the other plunger reaches its preset retracted position. Likewise, upon reversal of pump 230, the second biasing 327 member propels the second plunger 315 toward the extended position thereby following the same sequence of events as described.

The indexing circuit 300 further includes a first 320 and a second 322 check valve for selective communication from the indexing circuit 300 to the close loop circuit 200. The first 320 and second 322 check valves are arranged to allow fluid to enter the suction line of pressure compensated pump 230 in the closed loop circuit 200 as one plunger reaches its full extended position while the other plunger proceeds to its preset retracted position thereby maintaining volumetric balance in the system 100.

Figure 4:
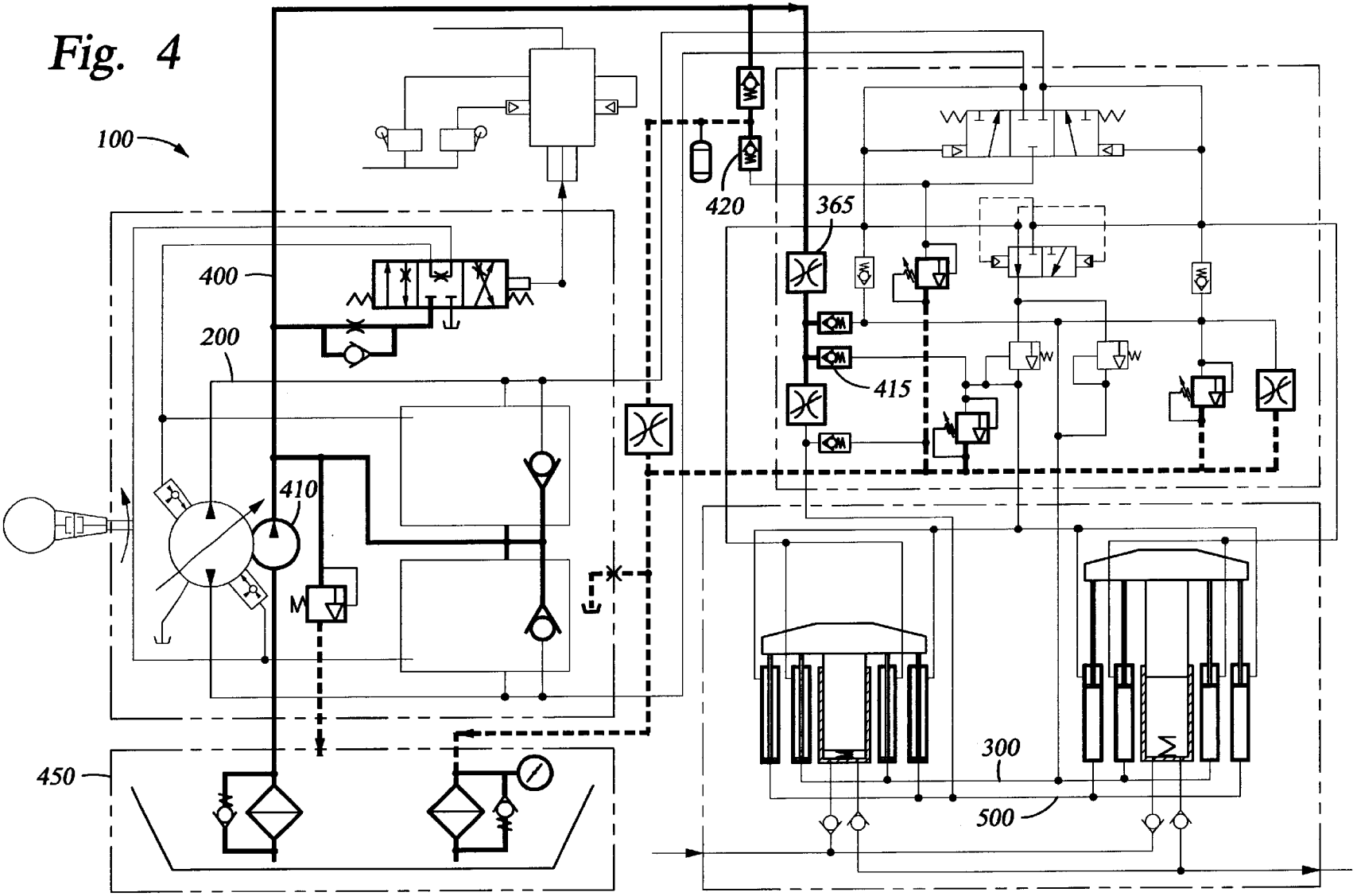
FIG. 4 is a schematic view showing a charging circuit in the hydraulically driven multiphase pump system.

FIG. 4 is a schematic view showing the charging circuit 400 in the hydraulically driven multiphase pump system 100. This circuit 400 picks up hydraulic fluid from a reservoir 450 and pumps it throughout the circuit 400 to re-supply the closed loop circuit 200, the indexing circuit 300 and the power saving circuit 500 with hydraulic fluid. The charge circuit 400 has a predetermined pressure that is maintained by a charging pump 410. The circuit also includes first 415 and a second 420 pressure sensing member. If the closed loop circuit pressure falls below the predetermined charge circuit pressure the first pressure sensing member 420 causes the introduction of hydraulic fluid into the close loop circuit 200 to replenish its supply of fluid. If the indexing circuit pressure falls below the predetermined charge circuit pressure the second pressure sensing member 415 causes the introduction of hydraulic fluid to flow into the indexing circuit 300 to replenish its supply of fluid. A hand operated valve 365 allows selective fluid communication from the charge circuit 400 to the indexing circuit 300. Any fluid not needed by the system 100 is surplus, and is returned to the reservoir 450.

Figure 5:
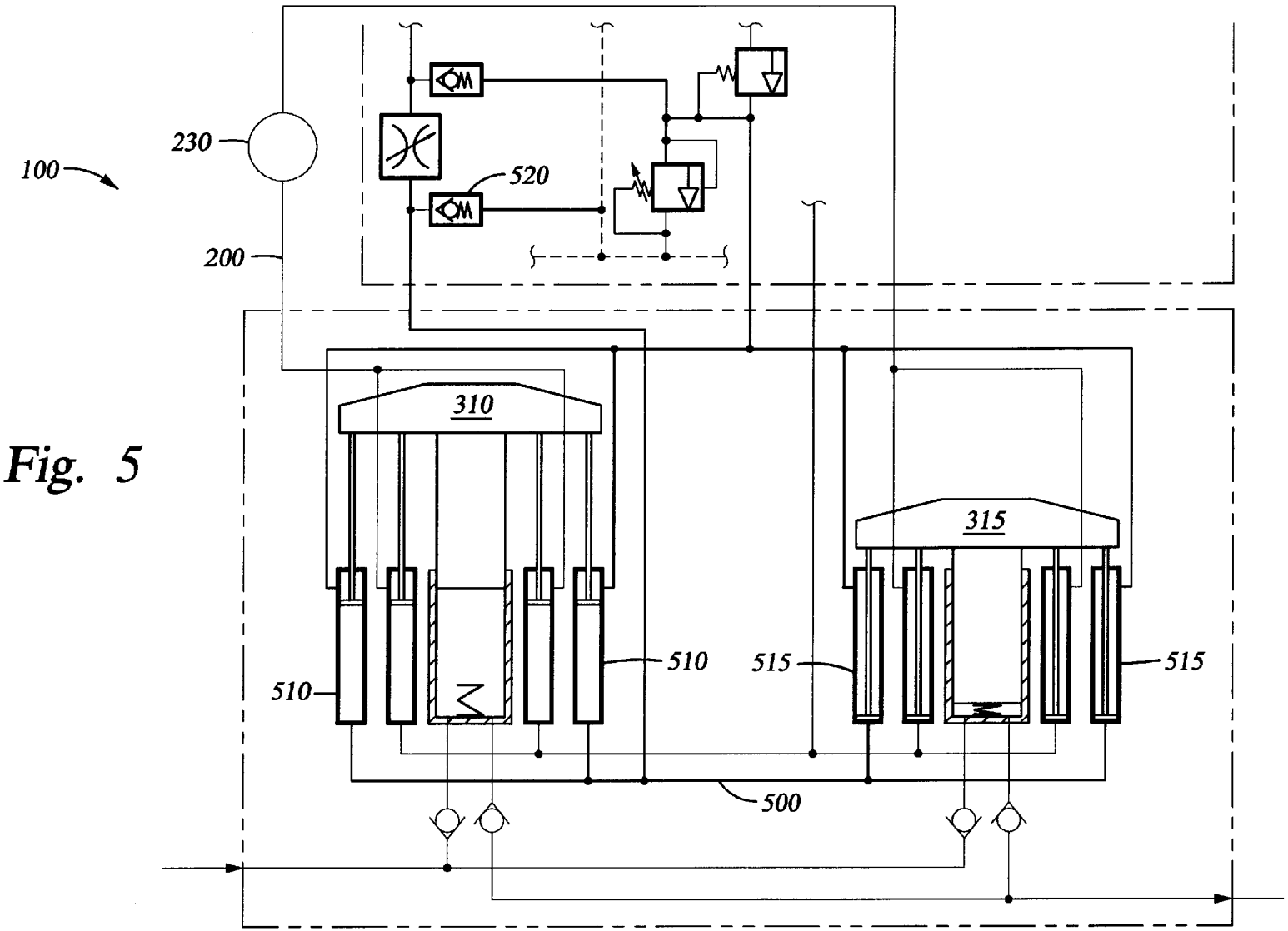
FIG. 5 illustrates a power saving circuit in the hydraulically driven multiphase pump system.

FIG. 5 illustrates the power saving circuit 500 in the hydraulically driven multiphase pump system 100. Circuit 500 will transfer energy between the plungers, 310, 315 as they move in opposite directions. The power saving circuit 500 includes a first and second power saving hydraulic cylinders 510 disposed adjacent to the first plunger 310 connected to a first and second power saving hydraulic cylinders 515 disposed adjacent to the second plunger 315. In high inlet pressure scenarios, the plunger moving toward the extended position is urged upwards by the inlet pressure of the fluidstream resulting in useful energy. This energy is transferred from the plunger moving toward its extended position to the plunger moving toward its preset retracted position by the power saving hydraulic cylinders 510, 515. Therefore, the amount of work needed from the pressure compensated pump 230 in the closed loop circuit 200 directed to the plunger moving toward the preset retracted position is substantially reduced. In low inlet pressure scenarios, the power saving circuit 500 in same manner as previously described may be economically applied where the plunger diameter is large thereby having a large surface area to act upon. Any excess fluid in the circuit 500 may be relieved to the reservoir 450 through valve 520. While the described embodiment in FIG. 5 includes hydraulic cylinders 510, 515, it will be understood that any mechanism that facilitates the transfer of energy such as sheaves, chains, or hydraulic cylinders could be used. Additionally, this invention is not limited to the orientation of the hydraulic cylinders as shown on FIG. 5 but rather may be disposed in any orientation that is necessary and effective.

While the foregoing is directed to embodiments of the present invention, other and further embodiments of the invention may be devised without departing from the basic scope thereof, and the scope thereof is determined by the claims that follow.

What is claimed is:

1. A fluid pumping system comprising:

a plurality of fluid pumps operable in a predetermined phase relationship;

a power fluid circuit for providing power fluid to the fluid pumps; and an indexing circuit for regulating the fluid in the power fluid circuit by introducing and removing fluid in the power fluid circuit throughout a pump cycle to allow one of the plurality of fluid pumps to reach a full extended position prior to another of the plurality of fluid pumps reaching a retracted position, whereby the indexing circuit ensures that the fluid pumps remain substantially in the predetermined phase relationship.

2. The system of claim 1, wherein the predetermined phase relationship is substantially counter synchronous.

3. A fluid pumping system comprising:

a pair of fluid pumps arranged to operate in a substantially counter synchronous manner;

a power fluid circuit for providing power fluid to and from the pair of fluid pumps; and an indexing circuit for regulating the fluid in the power fluid circuit by introducing and removing fluid in the power fluid circuit throughout a pump cycle to allow a first fluid pump to reach a full extended position prior to a second fluid pump reaching a retracted position, whereby the indexing circuit ensures that the pair of fluid pumps remain in substantially counter synchronous operation.

4. The system of claim 3, wherein the pair of substantially counter synchronous fluid pumps are a pair of plungers, each plunger movable between an extended position and a retracted position.

5. The system of claim 4, wherein at least one plunger is moved by a fluid operated cylinder.

6. The system of claim 3, wherein the indexing circuit further includes an acceleration valve in selective communication with the power fluid circuit and the indexing circuit.

7. The system of claim 6, wherein the acceleration valve is constructed and arranged to selectively redirect fluid from the power fluid circuit to the indexing circuit as the system completes a cycle and one of the fluid pumps moves from the extended position to the retracted position.

8. The system of claim 3, further including a charge circuit for providing fluid to the power fluid circuit and the indexing circuit.

9. The system of claim 8, wherein the charge circuit includes at least one pressure sensing member for introducing fluid into the power fluid circuit or the indexing circuit when the pressure in any one or more circuits falls below the charge circuit pressure.

10. The system of claim 9, further including at least one biasing member for biasing one of the fluid pumps as the fluid pump moves from the retracted position.

11. The system of claim 10, wherein the biasing member urges the fluid pump towards the extended position, thereby lowering a pressure in the indexing circuit below a pressure in the charge circuit, thereby causing the charge circuit to introduce fluid to the indexing circuit.

12. The system of claim 11, whereby the introduced fluid entering the indexing circuit urges one of the fluid pumps towards the extended position, thereby causing the fluid pump to reach its full extended position prior to the other fluid pump reaching its retracted position.

13. The system of claim 8, wherein the power fluid circuit further includes a valve member and an accumulator for ensuring adequate fluid in the power fluid circuit.

14. The system of claim 13, wherein the accumulator stores fluid from the charge circuit and the valve member is arranged between the accumulator and the power fluid circuit to permit fluid introduction to the power fluid circuit in the event that fluid pressure in the circuit falls below a preset valve.

15. The system of claim 3, wherein the power fluid circuit further includes a pump, a signal box and at least one pair of limit switches for controlling the direction of fluid in the circuit.

16. The system of claim 15, wherein the pair of limit switches are constructed and arranged to trigger the signal box upon arrival of one of the fluid pumps at the retracted position, thereby causing the pump to redirect the flow of fluid in the power fluid circuit.

17. The system of claim 15, whereby the pair of limit switches is adjustable to determine the retracted position of the fluid pump.

18. The system of claim 3, wherein the indexing circuit further includes at least one check valve for selective communication from the indexing circuit to the power fluid circuit.

19. The system of claim 18, wherein the check valve is constructed and arranged to allow fluid to enter a suction line of the power fluid circuit after one fluid pump reaches its full extended position and the other fluid pump moving to its retracted position thereby maintaining volumetric balance within the system.

20. The system of claim 3, further includes a power saving circuit including:

at least one valve member for directing fluid into the circuit; and a means for transferring energy between each fluid pump.

21. The system of claim 20, whereby an extending fluid pump is pushed upward by inlet pressures and energy is transferred from the extending fluid pump to a retracting fluid pump through the power saving circuit, thereby reducing the amount of energy needed to complete a pump cycle.

22. A pump system for transporting a fluidstream, the system comprising:

a first and a second plunger, each plunger movable between an extended position and a retracted position using a fluid operated cylinder;

a fluid power circuit for providing fluid to and from a first portion of the fluid operated cylinder; and an indexing circuit providing fluid to and from the fluid power circuit throughout a pump cycle; whereby the indexing circuit ensures that each plunger reaches its full extended position prior to the other plunger reaching the retracted position.

23. The system of claim 22, whereby the first portion is a rod end of the fluid operated cylinder.

24. The system of claim 22, further includes a power saving circuit including:

at least one valve member for directing fluid into the power saving circuit; and a means for transferring energy between each plunger.

25. The system of claim 24, whereby an extending plunger is pushed upward by inlet pressures and energy is transferred from the extending plunger to a retracting plunger through the power saving circuit, thereby reducing the amount of energy needed to complete a pump cycle.

26. A method for pumping a fluidstream comprising:

operating a pump system including:

a pair of substantially counter synchronous fluid pumps;

a fluid power circuit for providing fluid to and from the pair of fluid pumps;

an indexing circuit providing fluid to and from the fluid power circuit; and a charge circuit for providing fluid to the fluid power circuit and the indexing circuit; and biasing one of the fluid pumps as the fluid pump moves from the retracted position toward the extended position.

27. The method of claim 26, wherein biasing one of the fluid pumps as the fluid pump moves from the retracted position towards the extended position includes lowering a pressure in the indexing circuit below a pressure in the charge circuit to cause the charge circuit to introduce fluid to the indexing circuit resulting in the fluid pump reaching its full extended position prior to the other fluid pump reaching its retracted position.

28. A method for pumping a fluidstream comprising:

operating a pump system including:

a pair of substantially counter synchronous fluid pumps;

a fluid power circuit for providing fluid to and from the fluid pumps;

an indexing circuit providing fluid to and from the fluid power circuit;

a charge circuit for providing fluid to the fluid power circuit and the indexing circuit; and an acceleration valve in selective communication with the fluid power circuit and the indexing circuit; and ensuring that each fluid pump reaches its full extended position prior to the other fluid pump reaching the retracted position.

29. The method of claim 28, wherein ensuring that each fluid pump reaches its full extended position includes utilizing the acceleration valve to selectively redirect fluid from the fluid power circuit to the indexing circuit as the system completes a cycle and one of the fluid pumps moves from the extended position to the retracted position.

30. The method of claim 29, whereby the redirected fluid is introduced into the first portion of the pair of fluid operated cylinders on the extending fluid pump to urge the fluid pump toward the extended position prior to the other fluid pump reaching its retracted position.

31. A method for increasing efficiency while pumping a fluidstream comprising:

operating a pump system including:

a pair of substantially counter synchronous fluid pumps;

a fluid power circuit for providing fluid to and from the fluid pumps;

an indexing circuit providing fluid to and from the fluid power circuit; and a power saving circuit for providing fluid to and from a power saving cylinder; and transferring energy between the fluid pumps.

32. The method of claim 31, wherein transferring energy between the fluid pumps includes the use of inlet pressures to urge an extending fluid pump upward, thereby transferring energy from the extending fluid pump to a retracting fluid pump through the power saving circuit and reducing the amount of energy needed to complete a pump cycle.

33. A method for pumping a fluidstream comprising:

operating a pump system including:

a pair of substantially counter synchronous fluid pumps;

a fluid power circuit for providing fluid to and from the fluid pumps;

an indexing circuit providing fluid to and from the fluid power circuit;

a charge circuit for providing fluid to the fluid power circuit and the indexing circuit; and at least one valve assembly for selective communication from the indexing circuit to the power fluid circuit; and ensuring that each fluid pump reaches its full extended position prior to the other fluid pump reaching the retracted position.

34. The method of claim 33, wherein ensuring that each fluid pump reaches its full extended position includes utilizing the valve member to allow fluid to enter a suction line of the fluid power circuit after one fluid pump reaches its full extended position and the other fluid pump moving to its retracted position, thereby maintaining volumetric balance within the system.

35. A method for pumping a fluidstream comprising:

operating a pump system including:

a pair of substantially counter synchronous fluid pumps;

a fluid power circuit for providing fluid to and from the fluid pumps;

an indexing circuit providing fluid to and from the fluid power circuit;

a charge circuit for providing fluid to the fluid power circuit and the indexing circuit;

an accumulator for storing fluid; and a relief valve; and ensuring that each fluid pump reaches its full extended position prior to the other fluid pump reaching the retracted position.

36. The method of claim 35, wherein ensuring that each fluid pump reaches its full extended position includes utilizing the accumulator and the relief valve, whereby the accumulator stores fluid from the charge circuit and the relief valve is arranged between the accumulator and the fluid power circuit, thereby permitting fluid introduction into the fluid power circuit when a fluid pressure falls below a preset value.

* * * * *